US009080532B2

(12) United States Patent
Ko et al.

(10) Patent No.: US 9,080,532 B2
(45) Date of Patent: Jul. 14, 2015

(54) EXHAUST MANIFOLD AND DIFFUSER INTEGRATED CYLINDER HEAD

(71) Applicant: Hyundai Motor Company, Seoul (KR)

(72) Inventors: Seung Woo Ko, Seongnam-si (KR); Hyun Wook Ryu, Hwaseong-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 78 days.

(21) Appl. No.: 13/920,825

(22) Filed: Jun. 18, 2013

(65) Prior Publication Data

US 2014/0137818 A1 May 22, 2014

(30) Foreign Application Priority Data

Nov. 21, 2012 (KR) ..... 10-2012-0132153

(51) Int. Cl.
*F01N 1/00* (2006.01)
*F02F 1/24* (2006.01)
*F02F 1/36* (2006.01)

(52) U.S. Cl.
CPC .. *F02F 1/243* (2013.01); *F02F 1/36* (2013.01)

(58) Field of Classification Search
CPC ..... F01N 13/10; F01N 13/102; F01N 13/08; F01N 13/1805; F01N 13/14; F01N 13/02; F02M 25/0718; F02M 25/0742; F02M 25/074; F02B 3/06
USPC ..... 60/278, 280, 323, 598, 605.2; 123/568.13, 568.15, 568.17
See application file for complete search history.

(56) References Cited

U.S. PATENT DOCUMENTS

| | | | | | |
|---|---|---|---|---|---|
| 4,294,073 | A * | 10/1981 | Neff | 60/597 |
| 4,689,952 | A * | 9/1987 | Arthur et al. | 60/313 |
| 5,860,278 | A * | 1/1999 | Rodenkirch | 60/313 |
| 2009/0126659 | A1* | 5/2009 | Lester et al. | 123/41.72 |
| 2010/0296920 | A1* | 11/2010 | Koch | 415/180 |
| 2011/0132296 | A1* | 6/2011 | Kuhlbach | 123/41.82 R |
| 2011/0171017 | A1* | 7/2011 | Lingenauber et al. | 415/203 |
| 2013/0055971 | A1* | 3/2013 | Brewer et al. | 123/41.82 R |
| 2013/0086891 | A1* | 4/2013 | Ko et al. | 60/278 |
| 2013/0291540 | A1* | 11/2013 | Serres et al. | 60/605.1 |

FOREIGN PATENT DOCUMENTS

| | | | | |
|---|---|---|---|---|
| EP | 2143923 | A1 * | 1/2010 | |
| JP | 2002-303145 | A | 10/2002 | |
| JP | 2005133651 | A * | 5/2005 | F02B 37/02 |
| JP | 2005-188352 | A | 7/2005 | |
| JP | 2008-208738 | A | 9/2008 | |

(Continued)

OTHER PUBLICATIONS

Machine Translation of EP 2143923, Translated on Oct. 23, 2014.*

*Primary Examiner* — Thomas Denion
*Assistant Examiner* — Patrick Maines
(74) *Attorney, Agent, or Firm* — McDermott Will & Emery LLP

(57) ABSTRACT

An exhaust manifold and diffuser integrated cylinder head, includes an exhaust manifold and a exhaust passage. The exhaust manifold is integrally formed with the cylinder head. The exhaust passage is integrally formed with the cylinder head such that a turbocharger is mounted on a joining part of exhaust ports of the exhaust manifold and exhaust gas discharged from the exhaust passage flows to the turbocharger.

4 Claims, 9 Drawing Sheets

(56) References Cited

FOREIGN PATENT DOCUMENTS

| | | | | | |
|---|---|---|---|---|---|
| KR | 10-2009-0062255 | A | | 6/2009 | |
| KR | 2009-0105190 | A | | 10/2009 | |
| KR | 2009-0111183 | A | | 10/2009 | |
| KR | 10-2011-0062365 | A | | 6/2011 | |
| WO | WO-2010/015654 | A1 | | 2/2010 | |
| WO | WO 2010015654 | A1 | * | 2/2010 | ..... F02F 1/24 |

* cited by examiner

EXHAUST MANIFOLD AND DIFFUSER INTEGRATED CYLINDER HEAD

CROSS-REFERENCE TO RELATED APPLICATION

This application is based on and claims benefit of priority to Korean Patent Application No. 10-2012-0132153 filed Nov. 21, 2012 in the Korean Intellectual Property Office, the entire contents of which are incorporated herein by reference.

TECHNICAL FIELD

The present inventive concept relates to an exhaust manifold and diffuser integrated cylinder head. More particularly, the present inventive concept relates to an exhaust manifold and diffuser integrated cylinder head in which an exhaust manifold is integrated with a cylinder head, and a diffuser is integrated with an exhaust port of the exhaust manifold.

BACKGROUND

Generally, as shown in FIG. 1 of the accompanying drawings, the exhaust system of a diesel engine has a structure in which a cylinder head 10 and an exhaust manifold 12 are separately assembled, and the exhaust manifold 12 is mainly formed of an expensive Steel Use Stainless (SUS) material to endure a thermal load due to high-temperature exhaust gas. Also, the exhaust manifold 12 usually has a weight of 3 kg or more.

Recently, in view of the high oil price trends and the regulation reinforcement policies of exhaust gas, reducing the weight of the engine development is an important factor. To this end, engine components need to be modularized into one, or the development of new lightweight materials is needed.

As an example of achieving reduced weight by modularizing the engine components into one, the exhaust manifold 12 is being integrally manufactured with the cylinder head 10.

As shown in FIG. 2, in case of the exhaust manifold integrated cylinder head, the exhaust manifold 12 forming an exhaust port 14 is integrally formed with the cylinder head 10. A separate exhaust diffuser 16 for mounting a turbocharger is coupled to an outlet terminal of the integral exhaust manifold 12.

In this case, the outlet terminal (joining part) of the exhaust port of the exhaust manifold integrally formed with the cylinder head extends toward the diffuser 16. The shape of the diffuser has a vertical bent pipe to upwardly discharge exhaust gas from the exhaust port. Accordingly, the exhaust gas discharged from the diffuser 16 flows to the turbocharger connected to the upper side of the diffuser 16.

However, as shown in FIG. 3, which illustrates a simulation result of the pressure and the speed distribution of exhaust gas, since the typical diffuser 16 is disposed vertical to the exhaust port 14 of the exhaust manifold 12 integrally formed with the cylinder head 10, a rapid flow change occurs at a point where the diffuser 16 is connected to the exhaust port 14, thereby causing a flow stagnation of exhaust gas.

That is, since the exhaust port and the diffuser are almost perpendicular to each other when exhaust gas flows from the exhaust port of a horizontal array to the diffuser of a vertical array, an orthogonally bent portion acts as a flow resistance, thereby causing the flow stagnation of exhaust gas and thus reducing the flow coefficient of exhaust gas.

Also, as the diffuser is separately coupled to the outlet terminal (joining part) of the exhaust port of the exhaust manifold integrally formed with the cylinder head, the weight of the diffuser and cylinder head and the man-hours of manufacturing the diffuser and cylinder head may increase.

The above information disclosed in this Background section is only for enhancement of understanding of the background of the inventive concept and therefore it may contain information that does not form the prior art that is already known in this country to a person of ordinary skill in the art.

SUMMARY

The present inventive concept relates to an exhaust manifold and diffuser integrated cylinder head, which can facilitate the reduction of the weight of the diffuser and cylinder head and the man-hours of manufacturing the diffuser and cylinder head and minimize the flow resistance of exhaust gas, by integrating an exhaust manifold and a cylinder head and forming an exhaust passage for a diffuser in an outlet part (joining part) of exhaust ports of the exhaust manifold integrally formed with the cylinder head.

One aspect of the present inventive concept encompasses an exhaust manifold and diffuser integrated cylinder head including: an exhaust manifold integrally formed with the cylinder head; and a first exhaust passage integrally formed with the cylinder head such that a turbocharger is mounted on a joining part of exhaust ports of the exhaust manifold and exhaust gas discharged from the first exhaust passage flows to the turbocharger.

The first exhaust passage may be arranged to have an inclination angle of about 95 degrees to about 110 degrees with respect to the joining part of the exhaust ports that are horizontally arranged, and an inner diameter where the joining part of the exhaust ports and an inlet of the first exhaust passage meet each other may have a curved surface.

The exhaust manifold and diffuser integrated cylinder head may include cooling water passages inside the cylinder head over and under a point where the joining part of the exhaust ports and the inlet of the first exhaust passage for the diffuser meet each other.

The exhaust manifold and diffuser integrated cylinder head may include a second exhaust passage for exhaust gas recirculation at an end portion of one side of the exhaust port, allowing exhaust gas to flow into an exhaust gas recirculation device.

BRIEF DESCRIPTION OF THE DRAWINGS

The foregoing and other features of the inventive concept will be apparent from more particular description of embodiments of the inventive concept, as illustrated in the accompanying drawings in which like reference characters may refer to the same or similar parts throughout the different views. The drawings are not necessarily to scale, emphasis instead being placed upon illustrating the principles of the embodiments of the inventive concept. The accompanying drawings are given hereinbelow by way of illustration only, and thus are not limitative of the present inventive concept.

Figure 1:
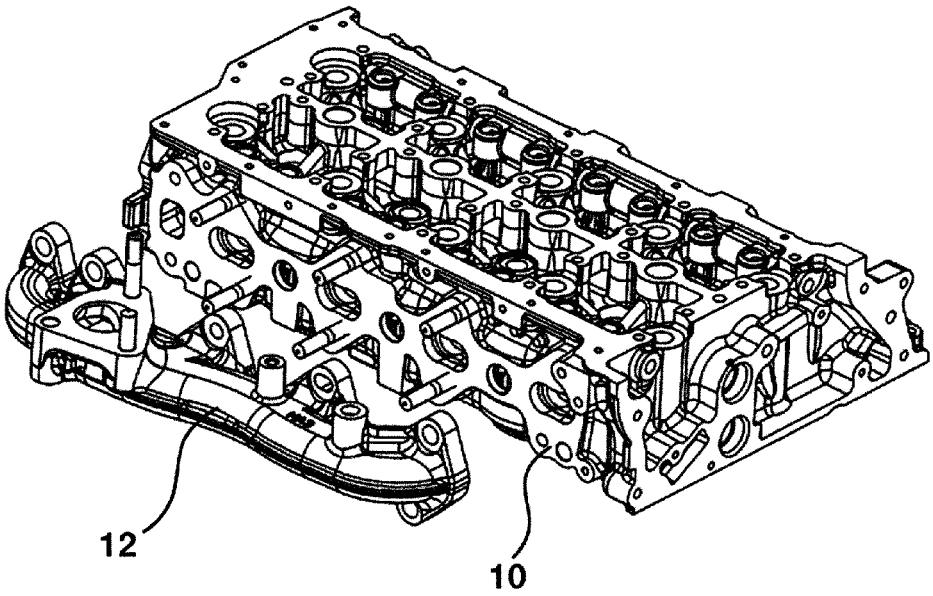
FIG. 1 is a view illustrating a cylinder head of a typical diesel engine.
Figure 2:
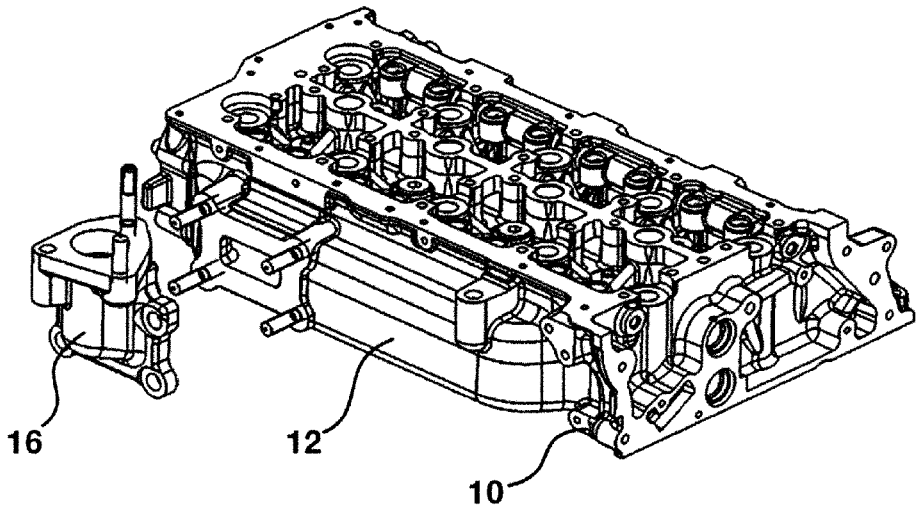
FIG. 2 is a view illustrating an exhaust diffuser coupled to an exhaust manifold integrated cylinder head.
Figure 3:
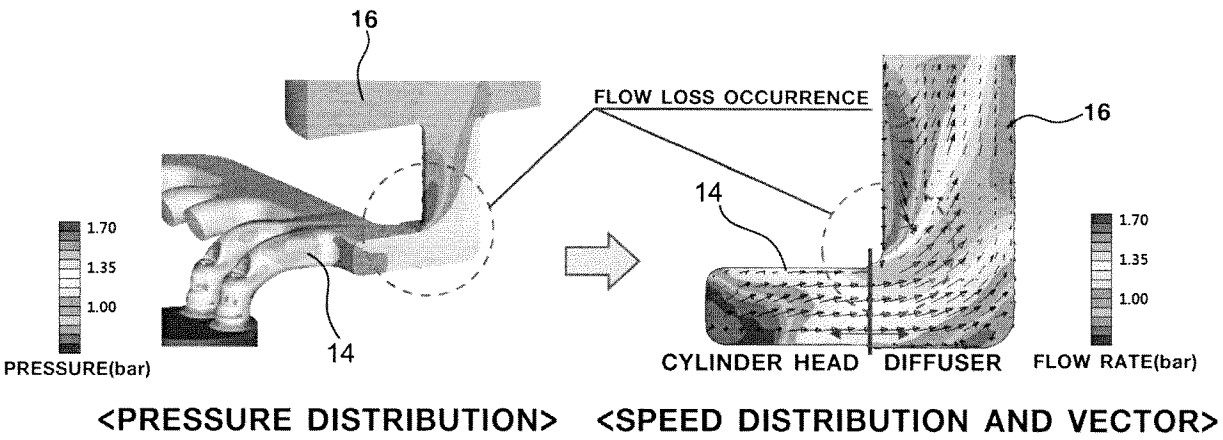
FIG. 3 is a view illustrating a test result when an exhaust diffuser is coupled to an exhaust manifold integrated cylinder head.

Reference numerals set forth in the Drawings includes reference to the following elements as further discussed below:

10: cylinder head
12: exhaust manifold
14: exhaust manifold
16: diffuser
18: exhaust passage for diffuser
20: exhaust passage for exhaust gas recirculation
22*a*, 22*b*: cooling water passage It should be understood that the accompanying drawings are not necessarily to scale, presenting a somewhat simplified representation of various exemplary features illustrative of the basic principles of the inventive concept. The specific design features of the present inventive concept as disclosed herein, including, for example, specific dimensions, orientations, locations, and shapes will be determined in part by a particular intended application and use environment.

In the figures, reference numbers refer to the same or equivalent parts of the present inventive concept throughout the several figures of the drawing.

DETAILED DESCRIPTION

Hereinafter reference will now be made in detail to various embodiments of the present inventive concept, examples of which are illustrated in the accompanying drawings and described below. While the inventive concept will be described in conjunction with exemplary embodiments, it will be understood that present description is not intended to limit the inventive concept to those exemplary embodiments. On the contrary, the inventive concept is intended to cover not only the exemplary embodiments, but also various alternatives, modifications, equivalents and other embodiments, which may be included within the spirit and scope of the inventive concept as defined by the appended claims.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

The above and other features of the inventive concept are discussed infra.

The present inventive concept relates to an exhaust manifold and diffuser integrated cylinder head, which allows a diffuser to be integrally formed with a cylinder head instead of being separately assembled in the related art, by integrating an exhaust manifold and a cylinder head and forming an exhaust passage that functions as a diffuser in an outlet part (joining part) of exhaust ports of the exhaust manifold integrally formed with the cylinder head.

Figure 4:
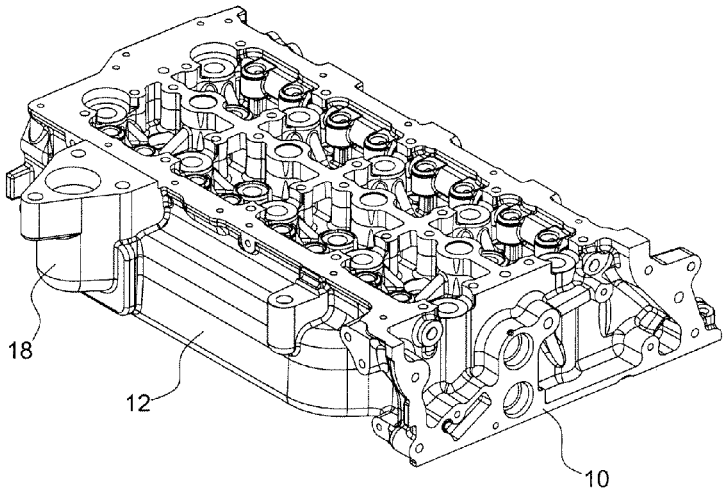
FIG. 4 is a view illustrating an exhaust manifold and diffuser integrated cylinder head according to an embodiment of the present inventive concept.
Figure 5:
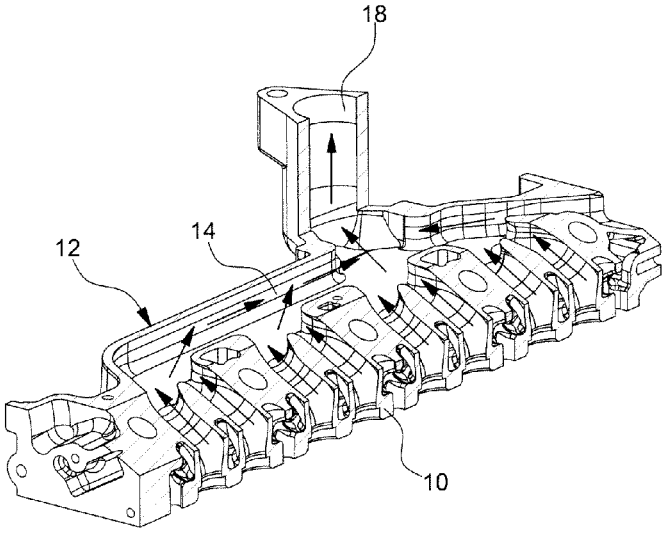
FIG. 5 is a view illustrating the internal structure of an exhaust manifold and diffuser integrated cylinder head according to an embodiment of the present inventive concept.
Figure 6:
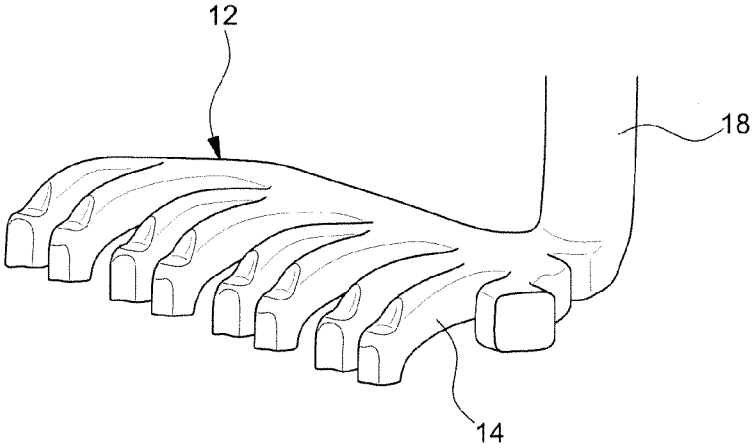
FIGS. 6 and 7 are views illustrating an exhaust port and a diffuser exhaust passage of an exhaust manifold and diffuser integrated cylinder head according to an embodiment of the present inventive concept.
Figure 7:
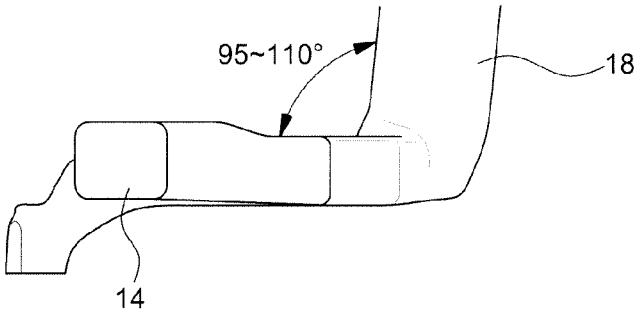

As shown in FIGS. 4 and 5, an exhaust manifold 12 including exhaust ports 14 with respect to each cylinder may be integrally formed with a cylinder head 10. The exhaust ports 14 may be joined into one.

Figure 10:
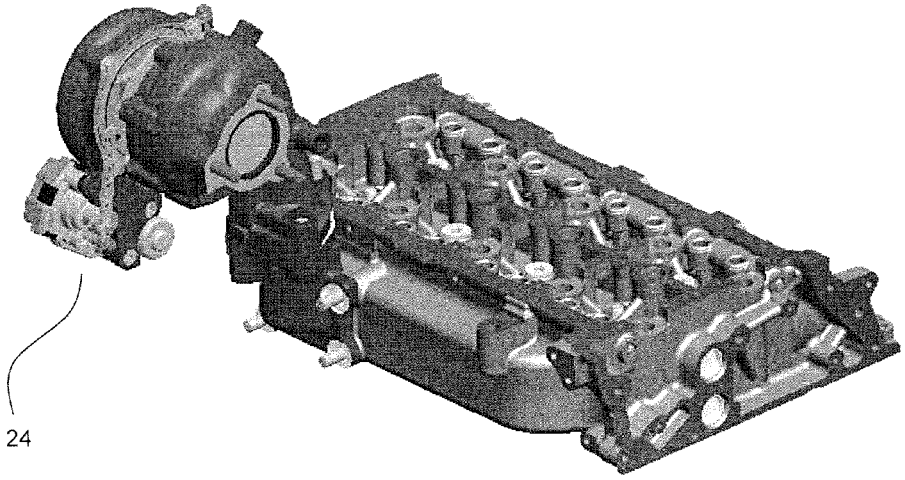
FIG. 10 is a view illustrating a turbocharger attached on the exhaust manifold and diffuser integrated cylinder head according to an embodiment of the present inventive concept.

Particularly, compared to a diffuser that is separately assembled, a first exhaust passage 18 that functions as a diffuser may upwardly extend from a certain location of a joining part where outlets of the exhaust port 14 are joined into one. A turbocharger 24 (see FIG. 10) may be directly mounted on an upper end portion of the first exhaust passage 18.

Figure 9A:
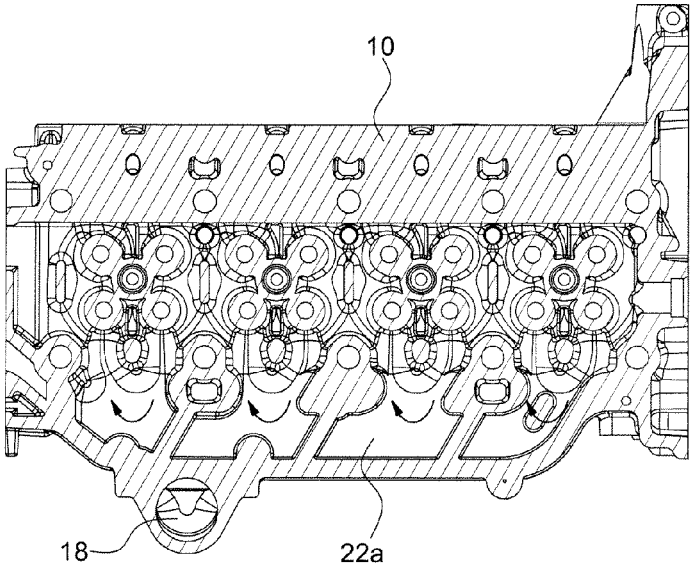
FIGS. 9A to 9C are cross-sectional views illustrating the internal structure of an exhaust manifold and diffuser integrated cylinder head according to an embodiment of the present inventive concept.
Figure 9B:
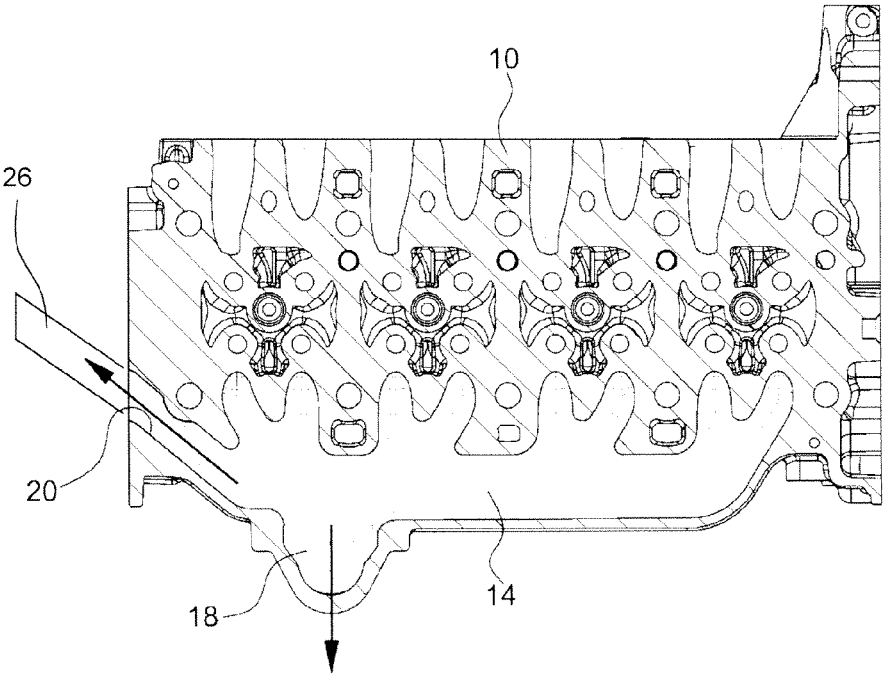

Also, as shown in FIG. 9B, a second exhaust passage 20 for exhaust gas recirculation may be formed on an end portion of one side of the exhaust port 14 to allow exhaust gas to flow into an Exhaust Gas Recirculation (EGR) pipeline 26 and thus recirculate a portion of exhaust gas to a combustion chamber (not separately shown).

In order to allow the exhaust manifold and a diffuser to be integrally formed with the cylinder head, a mold design work for manufacturing the cylinder head and a molding process using the mold may need to be preceded.

Thus, according to an embodiment of the present inventive concept, a diffuser that has been separately assembled is allowed to be integrally formed with the cylinder head by forming the exhaust passage 18 that functions as a diffuser on the outlet part (joining part) of the exhaust ports 14 of the exhaust manifold 12 integrally formed with the cylinder head 10. Therefore, the manufacturing cost and the weight of the cylinder head 10 can be reduced due to the omission of a separate exhaust diffuser and a separate gasket for mounting the separate diffuser.

Also, since a turbocharger can be directly coupled to the upper end portion of the exhaust passage 18, e.g., an upper end portion of the cylinder head 10, the overall size of an engine into which a plurality of components are assembled can be reduced.

According to an embodiment of the present inventive concept, the exhaust port 14 of the exhaust manifold 12 integrally formed with the cylinder head 10 and the exhaust passage 18 may be formed into one exhaust passage, thereby allowing the exhaust passage 18 to incline with respect to the outlet part of the exhaust port 14.

The exhaust passage 18 may have a slope of about 95 degrees to about 110 degrees with respect to the joining part of the exhaust ports that are horizontally arranged. Also, an inner diameter part where the joining part of the exhaust port 14 and an inlet of the exhaust passage 18 meet each other may be formed to have a curved surface.

Accordingly, the outlet part (joining part) of the exhaust port 14 and the exhaust passage 18 may be formed into one exhaust passage. Simultaneously, the slope of the exhaust passage 18 with respect to the outlet part of the exhaust port 14 may range from about 95 degrees to about 110 degrees, and a boundary part of the outlet part of the exhaust port 14 and the exhaust passage 18 may be formed to have a curved surface. Thus, smooth exhaust flow can be induced without occurrence of a flow resistance of exhaust gas due to a rapid flow change thereof at an inlet part of a diffuser that is separately assembled, thereby minimizing the flow resistance of exhaust gas.

Figure 8:
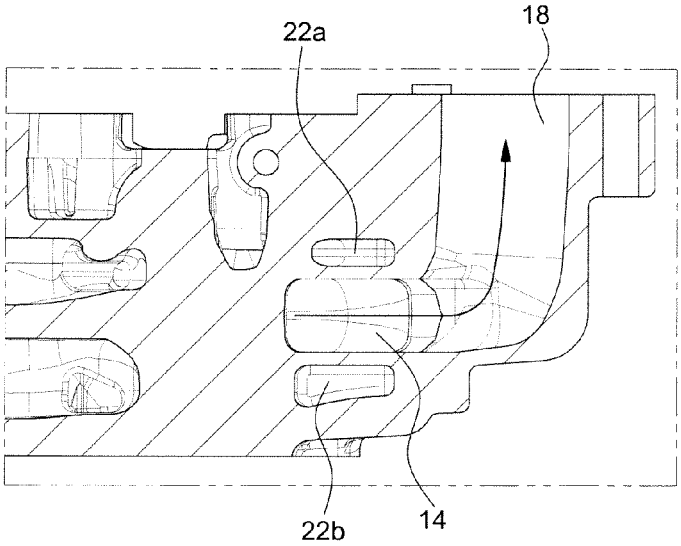
FIG. 8 is a cross-sectional view illustrating a cooling water passage in an exhaust manifold and diffuser integrated cylinder head according to an embodiment of the present inventive concept.

Also, cooling passages 22*a* and 22*b* (see FIG. 8) in which engine cooling water circulates may be formed in the cylinder head over and under a point where the joining part of the exhaust port 14 and the inlet of the exhaust passage 18 meet each other.

Figure 9C:
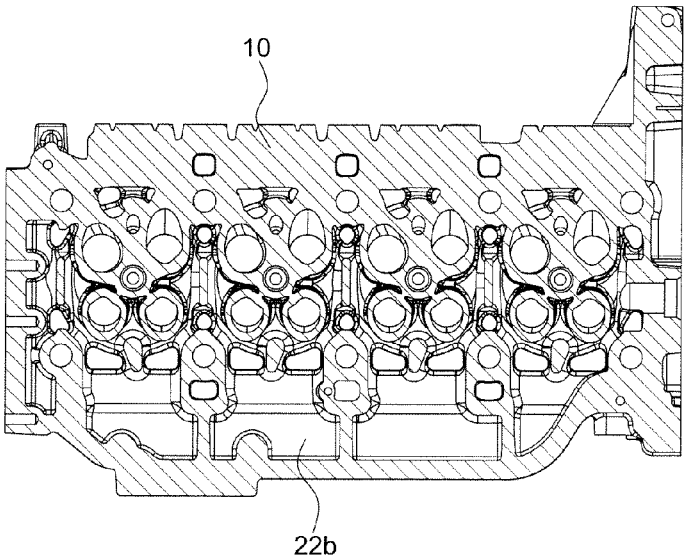

That is, as shown in FIGS. 9A and 9C, the cooling passage 22*a* over the exhaust passage 18 may be formed to be an independent cooling passage communicating with each cylinder of the cylinder head 10. As shown in FIG. 9C, the cooling passage 22*b* under the exhaust passage 18 may be formed to have a water jacket structure, enabling cooling for high-temperature exhaust gas flowing in the exhaust port 14 and the exhaust passage 18.

Accordingly, when high-temperature exhaust gas flows along the exhaust port 14 of the exhaust manifold 12 integrally formed with the cylinder head 10 and the exhaust passage 18 integrally extending from the exhaust port 14, cooling water flowing in the upper and lower cooling water passages 22*a* and 22*b* may perform cooling action, thereby preventing occurrence of a crack on the wall surface of the exhaust passage 18 and the exhaust port due to a heat damage caused by high-temperature exhaust gas.

The present inventive concept may have the following advantages.

Since a diffuser integrated structure is manufactured by integrally forming an exhaust manifold with a cylinder head and forming an exhaust passage that functions as a diffuser on the outlet part (joining part) of exhaust ports of the exhaust manifold integrally formed with the cylinder head, the manufacturing cost and the weight can be reduced due to the omission of a separate exhaust diffuser and a gasket for mounting the separate diffuser.

Also, the flow resistance of exhaust gas can be minimized by forming the outlet part (joining part) of the exhaust ports and the exhaust passage into one exhaust passage and allowing the exhaust passage to incline with respect to the outlet part of the exhaust ports.

Also, occurrence of a crack due to high-temperature exhaust gas can be prevented by forming cooling water passages in the cylinder head over and under a point where the outlet part of the exhaust port and the exhaust passage meet each other.

In addition, the overall size of the engine including a plurality of components can be reduced by directly coupling a turbocharger to an upper end portion of the exhaust passage communicating with the outlet part of the exhaust port, e.g., an upper end portion of the cylinder head.

The inventive concept has been described in detail with reference to exemplary embodiments thereof. However, it will be appreciated by those skilled in the art that changes may be made in these embodiments without departing from the principles and spirit of the inventive concept, the scope of which is defined in the appended claims and their equivalents.

What is claimed is:

1. An exhaust manifold and diffuser integrated cylinder head, comprising:

an exhaust manifold integrally formed with a diffuser integrated cylinder head; and a first exhaust passage integrally formed with the diffuser integrated cylinder head such that a turbocharger is mounted at an outlet of exhaust ports of the exhaust manifold and exhaust gas discharged from the first exhaust passage flows to the turbocharger, wherein the exhaust ports are horizontally arranged, the first exhaust passage extends slantly and upwardly from the exhaust ports at an angle of 95 degrees to 110 degrees with respect to the outlet of the exhaust ports, and the outlet of the exhaust ports and an inlet of the first exhaust passage are joined to form a curved surface therein.

2. The exhaust manifold and diffuser integrated cylinder head of claim 1, further comprising cooling water passages inside the diffuser integrated cylinder head over and under a point where the outlet of the exhaust ports and the inlet of the first exhaust passage meet each other.

3. The exhaust manifold and diffuser integrated cylinder head of claim 1 further comprising a second exhaust passage for exhaust gas recirculation (EGR) at an end portion of one side of the exhaust ports, allowing exhaust gas to flow into an EGR pipeline.

4. The exhaust manifold and diffuser integrated cylinder head of claim 1, further comprising cooling water passages inside the diffuser integrated cylinder head over and under a point where the outlet of the exhaust ports and the inlet of the first exhaust passage meet each other.

* * * * *